US005092640A

United States Patent [19]

Plummer

[11] Patent Number: 5,092,640

[45] Date of Patent: Mar. 3, 1992

[54] APPARATUS AND METHOD FOR LATCHING SLIDING CLOSURES

[75] Inventor: David D. Plummer, Hudson, Wis.

[73] Assignee: Andersen Corporation, Bayport, Minn.

[21] Appl. No.: 689,296

[22] Filed: Apr. 22, 1991

[51] Int. Cl.[5] ..... E05C 3/06

[52] U.S. Cl. ..... 292/247; 292/197; 292/241

[58] Field of Search ..... 292/246, 247, 240, 241, 292/242, DIG. 47, 197, 98, 111, 132, 215, 224

[56] References Cited

U.S. PATENT DOCUMENTS

| | | | |
|---|---|---|---|
| 1,286,857 | 12/1918 | Fischer et al. | 292/197 |
| 1,615,944 | 2/1927 | Hetrick | 292/240 |
| 1,900,936 | 3/1933 | Huttger | 292/240 |
| 2,787,487 | 4/1957 | Baker | 292/240 |
| 2,981,560 | 4/1961 | Wehner | 292/197 |
| 3,811,718 | 5/1974 | Bates | 292/241 |
| 4,189,174 | 2/1980 | Van Parys | 292/98 |
| 4,679,835 | 7/1987 | Weinerman et al. | 292/197 |
| 4,869,023 | 9/1989 | Bakula et al. | 292/241 |

FOREIGN PATENT DOCUMENTS

| | | | |
|---|---|---|---|
| 346751 | 3/1937 | Italy | 292/242 |
| 561836 | 5/1975 | Switzerland | 292/199 |

*Primary Examiner*—Eric K. Nicholson
*Attorney, Agent, or Firm*—Merchant, Gould, Smith, Edell, Welter & Schmidt

[57] ABSTRACT

An improved method and apparatus for latching and securing closure members within a frame are disclosed. A switching latch operatively secured to a first closure member engages a keeper secured to a second closure member and is rotationally operable to secure the closure members within the frame by simultaneously imparting translational forces to closure members through the keeper along two mutually orthogonal axes.

15 Claims, 3 Drawing Sheets

FIG. 5
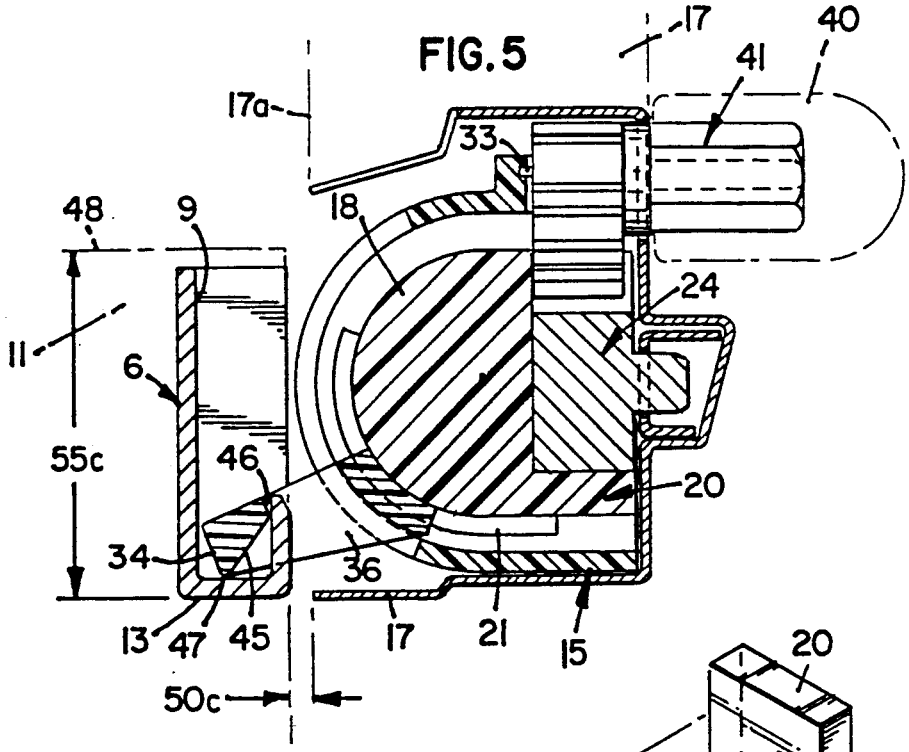
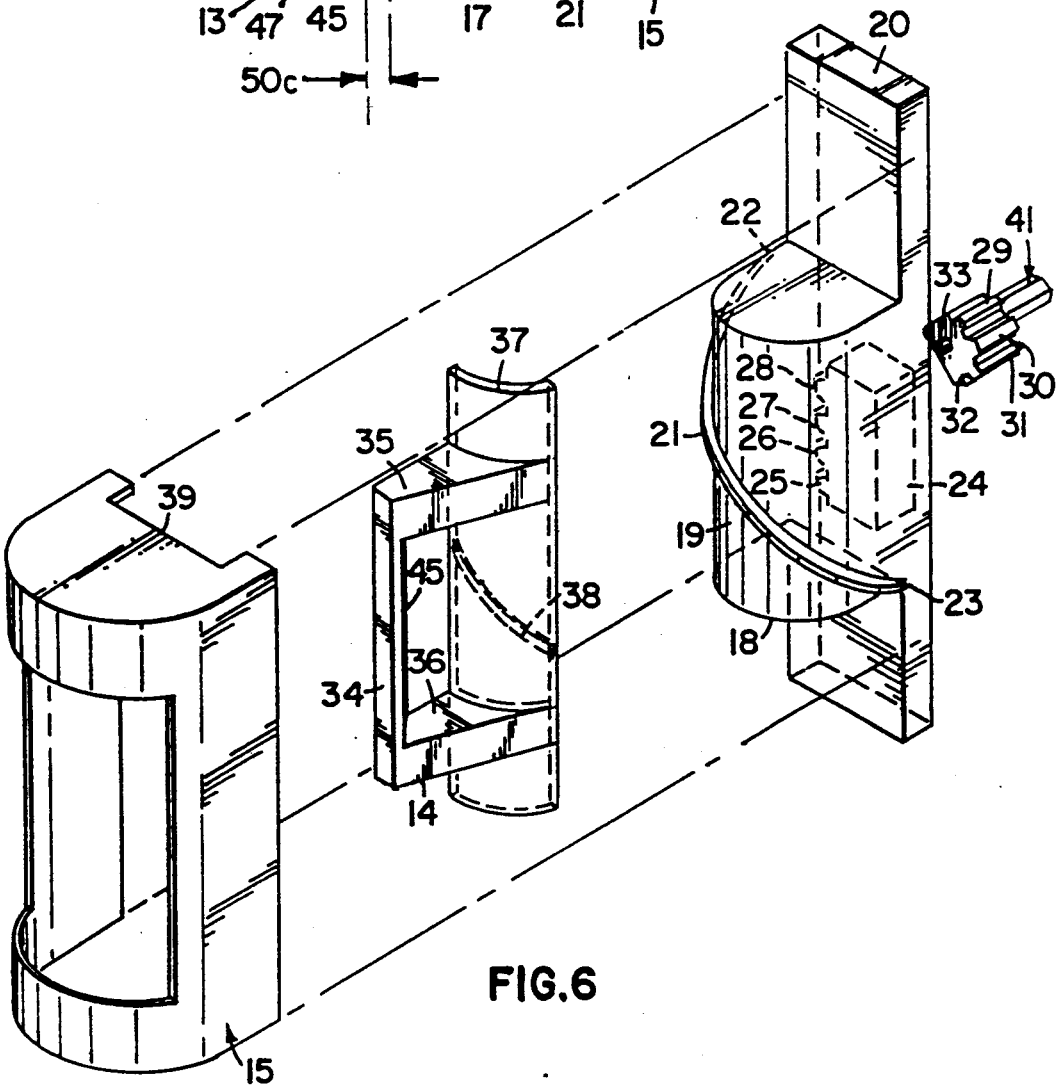
FIG. 6

APPARATUS AND METHOD FOR LATCHING SLIDING CLOSURES

BACKGROUND OF THE INVENTION

1. Field of the Invention

The present invention relates generally to a latch mechanism for securing sliding doors or windows, and more particularly to a latch mechanism which applies forces along two orthogonal axes simultaneously so as to secure the window or door within its associated jamb and improve its relative seal therewith.

2. Cross-Reference to Related Patents

To the extent that disclosures of U.S. Pat. No. 4,976,066 issued on Dec. 11, 1990, to Plummer et al. are necessary for understanding this invention, they are herein incorporated by reference.

3. Description of Related Technology

Numerous mechanisms have been devised to facilitate securing a window, door, or other movable closure panel while permitting the closure member to be readily reopened as needed. A number of such devices have recognized the advantages of dual motion that can be achieved by latching mechanisms which include both rotational and translational components.

For example, U.S. Pat. No. 261,998, issued to Carson, discloses a sash holder in which a cylinder having a spiral groove is rotated adjacent to a plate having an outwardly projecting stud which engages the spiral groove. The plate is mounted on the window frame, while the rotating cylinder is mounted on the sash. As the cylinder is rotated, the stud engages and imparts forces to the cylinder, causing the cylinder to translate along its longitudinal axis, thereby locking the window sash in place.

U.S. Pat. No. 1,286,857, issued to Fischer et al., discloses a door latch having a conventional appearing doorknob mounted on the door. However, rather than rotating the doorknob to release the latch, a small finger plate is placed in the center of the doorknob which is connected to a shaft passing through the door which engages the latch. A spiral rib on the longitudinal shaft causes the shaft to rotate, and thereby release the latch, as the finger plate is pressed.

U.S. Pat. No. 2,128,405, issued to Eastman, discloses a window sealing arrangement utilizing two members which pivot about orthogonal axes. One of the members is a handle having a cam-shaped slot which engages a projection which forms a part of the other pivoted member. When the handle with the cam-shaped slot is rotated, the cam-shaped slot deflects the projection so as to cause the second rotating member to pivot about its axis, thereby engaging or releasing a specially designed trough in a window sash.

U.S. Pat. No. 3,179,454, issued to Mummendey, discloses a sash locking arrangement which permits a sash to be locked at intermediate positions along the window frame. A pair of inclined surfaces define a spiral groove in which a finger travels, the finger being attached to a rotatable shaft. The inclined surfaces are rigidly attached to a handle which may be moved parallel to the longitudinal axis of the rotating shaft.

U.S. Pat. No. 3,560,037, issued to Crain, discloses a latching element which is translated by an actuator having a guide member which slides within an aperture in the surface of the latching element and along first and second camming members located on either side of the guide members. The first and second extensions on the latching element flange slidably engage sloping surfaces of the first and second camming members, resulting in translation of latching element in the direction normal to the displacement of the actuator.

U.S. Pat. No. 4,679,835, issued to Weinerman et al., discloses a cabinet latch having a passage formed through the body along a center axis, and opens through forward and rearward end regions of the body. A primary operating element is journaled for rotation within the forward end region of the body passage, and a shank that has a portion which projects from the rearward end region of the body passage carries a pawl. A half turn rotation of the primary operating element in one direction of rotation causes the pawl to move in sequence by rotating a quarter turn about the center axis from an unlatched position to a latched position and by translating axially along the center axis from the latched position to a latched clamp position. A cylindrical element having a spiral groove is responsible for the translational movement.

None of such prior art structures adequately address the dual security and weathertightness seal problems encountered with actual sliding window or door installations having one or a plurality of moving members. When a sliding window or door is in its closed position, a latching device ideally should press the window or door toward its associated frame jambs in two directions. First, the window or door panel should be forced along the horizontal sliding line of movement for the panel, away from its associated window or door panels so that the window or door panel members seat properly along the extreme ends or side jambs of the frame. In addition, the window or door members must be drawn together in a second, horizontal direction orthogonal to the direction of sliding movement of the window or door, so that weather stripping or other sealing material is uniformly engaged by the window or door panel surfaces when the panels are secured in a closed, locked position. Ideally, operation of such a latch should be by a simple one-stroke movement which is easily accomplished by hand. Such operator motion would generally comprise either a simple linear or arcuate stroke of a handle or a rotational twist of an operator knob. Since the desired forces on the window or door panels ultimately require primarily translational movements, what is required is a latching device which will convert the initial operator initiated movement into translational movement along two orthogonal horizontal directions. The present invention provides such an operator mechanism that is simple to operate, requires little operator effort yet results in superior sealing engagement of the sliding window or door panels within their associated frames.

SUMMARY OF THE INVENTION

Accordingly, the present invention provides a method and apparatus for securing cooperative closure panels such that translation closure forces are simultaneously applied to the panels along two orthogonal horizontal axes. The latching apparatus includes three primary functions which permit an operator initiated motion to be converted first into a vertical translational motion which is in turn converted into a rotational motion about a vertical axis, which in turn operates a latch that applies translational forces along two orthogonal horizontal axes to the closure member(s).

According to one aspect of the invention, there is provided a sliding closure securing assembly having:

(a) a keeper member, the keeper member being rigidly affixed to a first closure panel; and (b) a swinging latch mounted to a second closure panel in a manner such that rotational movement of the swinging latch causes engagement of the latch with the keeper member to urge the keeper member to translate along two mutually orthogonal axes. In a preferred configuration of the closure securing assembly includes a cylinder sector surface member to which the latch is affixed, wherein the cylinder sector surface member is configured to rotate about an axis which is mutually orthogonal to the other two orthogonal translational force axes.

According to a second aspect of the invention, there is provided a latching mechanism having:

(a) a base member;

(b) at least a portion of a cylinder that is affixed to the base member;

(c) a track formed along the surface of the cylinder portion;

(d) a discrete cylinder sector surface cooperatively slidably engaged with the surface of the cylinder portion;

(e) a mating track segment formed within a portion of the cylinder sector surface and engaging the track on the surface of the cylinder portion; and (f) a latch affixed to the cylinder sector surface such that translational movement of the base member causes the latch to rotate about an axis parallel to the direction of translational movement.

According to yet another aspect of the invention, there is provided a method of securing cooperatively sliding closure panels, comprising:

(a) mounting a keeper member on a first sliding closure panel;

(b) mounting a swinging latch on a second sliding closure panel in cooperative alignment with the keeper member; and (c) rotating said swinging latch so as to engage said keeper member therewith, wherein rotation of the latch simultaneously imparts translation forces to said keeper member along two mutually orthogonal axes.

According to yet another aspect of the invention, there is provided a sliding closure assembly comprising:

(a) a first closure member;

(b) a second closure member;

(c) frame means for cooperatively mounting said first and said second closure members in generally parallel spaced apart relationship to one another wherein said second closure member is longitudinally movable relative to said first closure member;

(d) a keeper mounted on said first closure member; and (e) swinging latch means mounted to said second closure member for cooperative alignment with said keeper, for rotatably engaging said keeper in a manner that simultaneously imparts translational forces to said keeper member along two mutually orthogonal axes.

While the preferred embodiment of the present invention will be described relevant to its operation with a sliding glass window, it will be understood that such description is only intended to represent one example of an application of use for the inventive latching mechanism. The claimed principles of operation of this invention are not limited to association with sliding window or door structures or to any particular sliding window or door configuration. This invention applies generally to its association with sliding closure panel members that move relative to frame member and are operative to selectively open or close access through such frame member. Similarly, while the invention will be described with respect to sliding window or door configurations having multiple sliding panel members, the principles of the invention apply equally well to use with structures wherein a single movable closure member is employed. Further, while the preferred embodiment of the invention is described with regard to its operative use with sliding closure members, its use need not be limited to use with sliding closure members but could conceivably be used with movable closure members capable of other than longitudinal sliding motion. Further, while the preferred embodiment of the invention will be described with respect to particular materials and shapes of interacting movable components, other than as claimed herein, the invention is not to be limited to such materials or parts configurations. These and other variations of the invention will become apparent to those skilled in the art upon a more detailed description of the invention.

BRIEF DESCRIPTION OF THE DRAWINGS

FIG. 5 is a sectional view taken along line 3—3 of FIG. 2 showing the latch assembly in a third, closed or secured operative position; and FIG. 6 is an exploded perspective view showing the movable portions of the latch mechanism of FIG. 1.

DETAILED DESCRIPTION OF THE PREFERRED EMBODIMENTS

Figure 1:
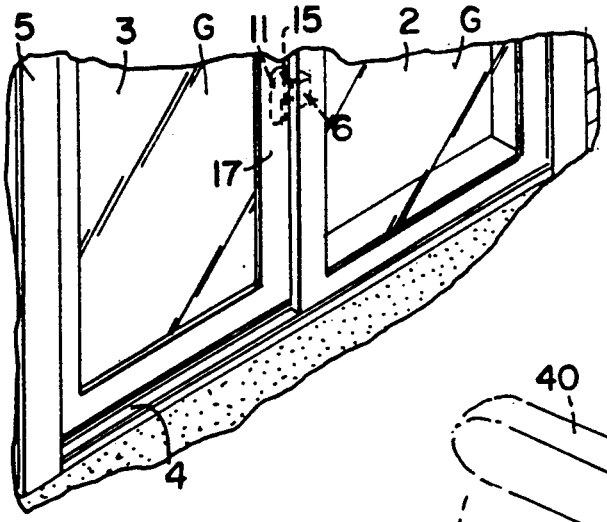
FIG. 1 is a perspective view of a portion of a sliding glass door or window assembly upon which a latch assembly constructed in accordance with the principles of the present invention is mounted.

As seen generally in FIG. 1, a portion of a typical sliding glass door or window 1 is depicted. Such sliding window and door assemblies are well-known in the art and will not be described in great detail herein. To the extent that a more in-depth understanding of such structures is desired, reference is made to U.S. Pat. No. 4,976,066 for a Sliding Window Apparatus and Method issued on Dec. 11, 1990, and assigned to the common assignee of this invention, Andersen Corporation. To the extent that the disclosures of U.S. Pat. No. 4,976,066 are relevant to completing the description of how this invention operates in combination with a sliding window or door structure, such patent is incorporated by reference herein as fully as though it formed a part of this specification. Such window or door configurations typically include two sash or panel portions, namely a first panel 2, which may be movable or stationary, and a second movable or sliding panel 3, which together form the completed window or door 1. Since the cross-referenced U.S. Pat. No. 4,976,066 patent describes a "window" structure, for ease of description, the remainder of this specification will refer to the structure of FIG. 1 as a "window" structure, it being understood that the principles of the invention apply to "closure" structures in general.

In the preferred embodiment, panel 2 longitudinally slides along a track 4 which is parallel and lies adjacent to another track (not shown) within which panel 3 slides. In the preferred embodiment, the window panels 2 and 3 have outer sash members 11 and 17 in which glass panes "G" are mounted. As may be readily appreciated, the window frame 5 may have its interior portion which abuts the sliding panels 2 and 3 of window 1 lined, surrounded or otherwise coated with weather stripping, sealant, or other material designed to form a weathertight seal between the frame 5 and the panels 2 and 3 of the window 1. A portion of the weather stripping material may be mounted to or form an integral part of the window panels themselves, and slide along with the window panels 2 and 3 as they are moved relative to the frame 5. As is well-known in the art, the weather stripping cannot serve its sealing purpose unless firm abutting or compressive relationships exist between the window panels, the track and the frame when the window panels are disposed in a "closed" position.

The latch assembly of this invention is graphically depicted in FIG. 1 as it would typically be positioned in relation to a sliding window 1 assembly so as to operatively engage and latch both window panels 2 and 3, as described in more detail below.

Figure 2:
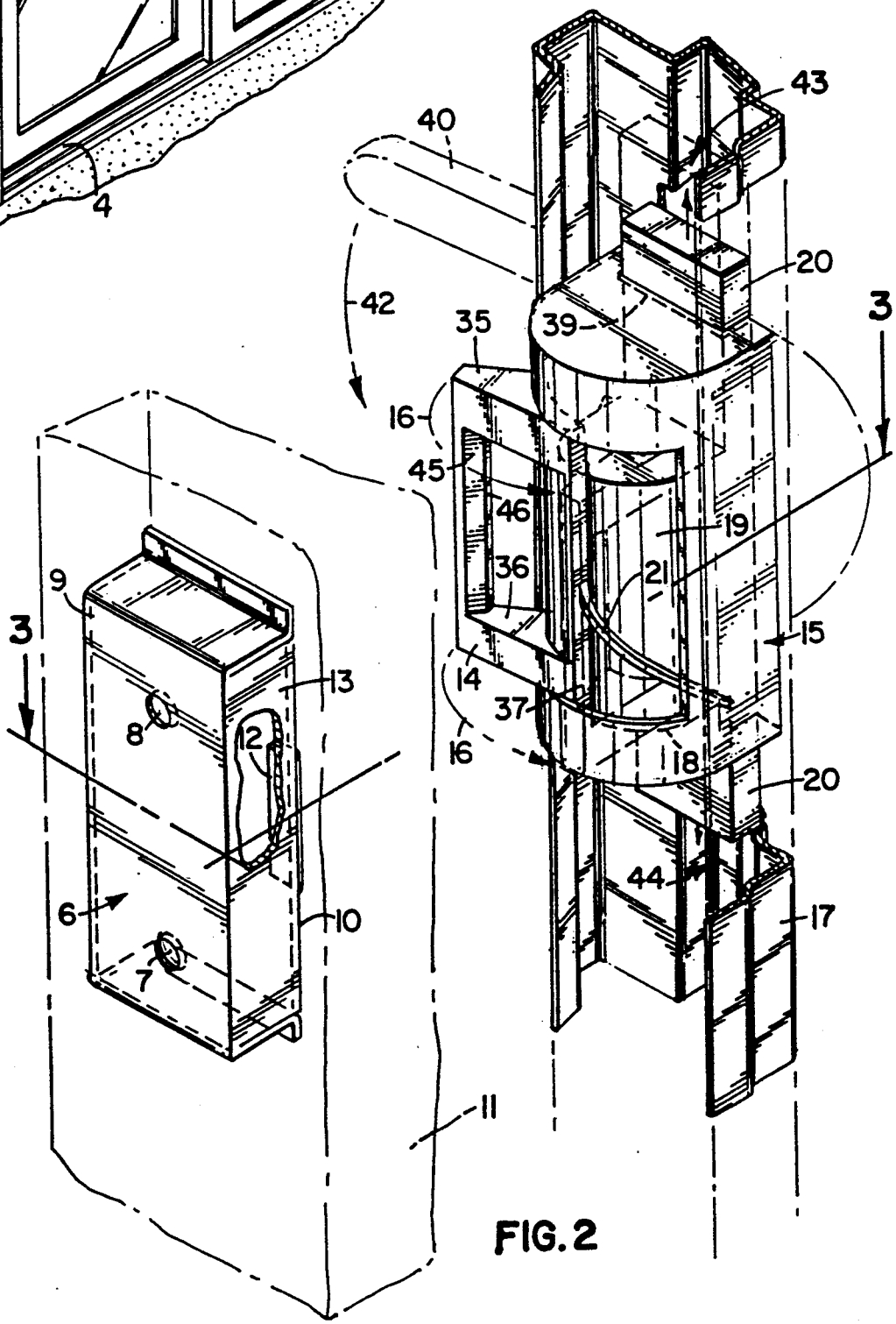
FIG. 2 is a perspective view of the latch assembly of FIG. 1, illustrating the latch in an open, unsecured position.

Referring to FIG. 2, the improved latch assembly is illustrated in enlarged detail. The latch assembly includes a keeper 6 which is illustrated as mounted to window panel 2 by means of suitable threaded fasteners passing through orifices 7 and 8 which are punched or drilled through rear wall 9 of keeper 6. The keeper 6 is typically recessed within the sash of window panel 2 such that the forward or operatively visible surface 10 of keeper 6 is flush with the exposed outer surface of window panel 2 and the rear wall 9 of the keeper is recessed or spaced back from the outer surface of the window panel. Alternatively, the keeper assembly 6 may be formed integrally within the sash 11 of window panel 2. In the preferred embodiment, the keeper 6 is formed so as to have a small plate or protrusion 12 extending outwardly from side wall 13 of keeper 6 such that there is a finite space between rear wall 9 and protrusion 12 thereby permitting a latch to engage protrusion 12 without interference from rear wall 9 of keeper 6. Although a rectangular plate is shown for the protrusion 12, the protrusion may have any shape or configuration which would permit it to be grasped by a mating latch assembly, as will become more apparent hereinafter.

Figure 4:
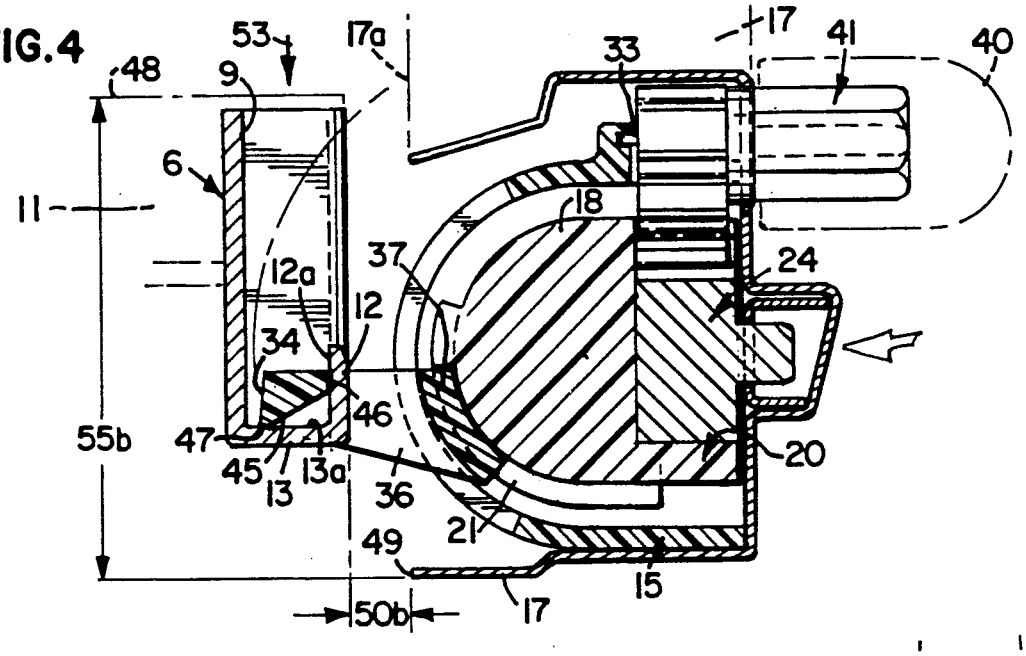
FIG. 4 is a sectional view taken along line 3—3 of FIG. 2 showing the latch assembly in a second, partially closed operative position.
Figure 3:
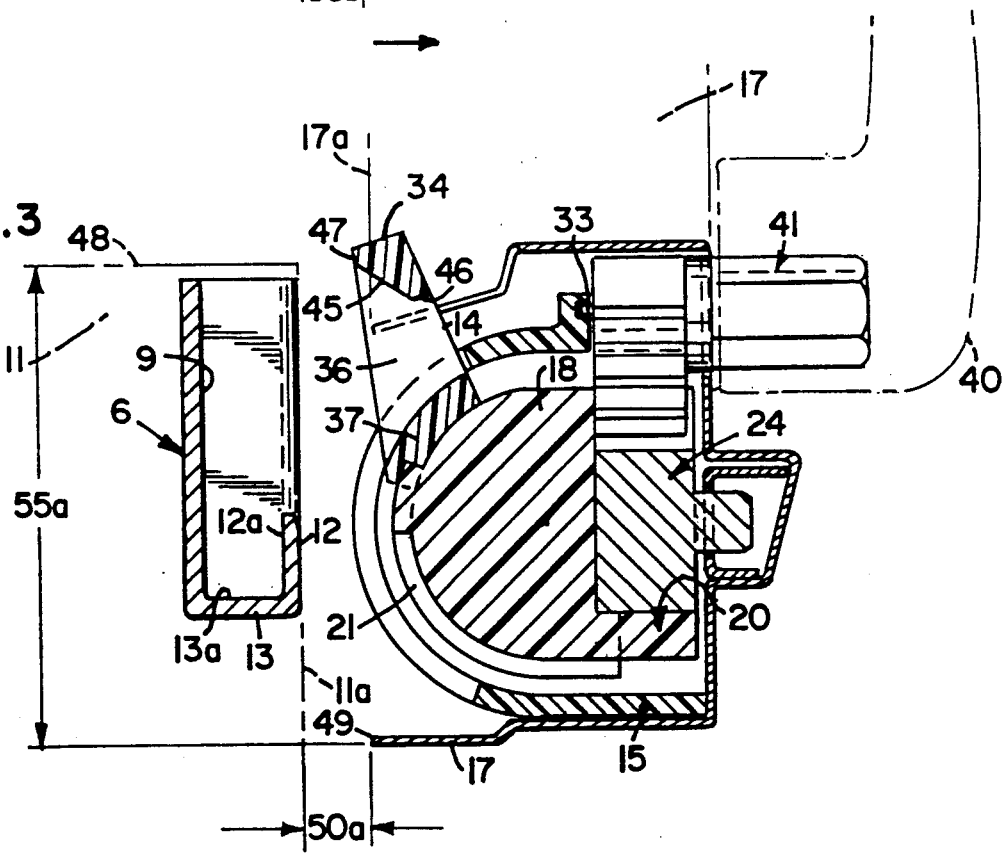
FIG. 3 is a sectional view taken along line 3—3 of FIG. 2 showing the latch assembly in a first, open or unsecured position.

Referring to FIGS. 2 and 6, the movable, operative portions of the latch assembly are illustrated. Latching arm 14 is constrained within housing 15 so as to be capable of rotational movement in the direction shown by arrows 16. Housing 15 is rigidly affixed to window panel 3 and is aligned relative to the keeper 6 of window panel 2 so as to allow latch member 14 to be opposite keeper protrusion 12, for cooperative engagement therewith. Housing 15 may be rigidly attached to sash 17 of panel 3 or may be integrally formed as part of the sash or panel member, and is mounted relative to the outer surface of the sash as illustrated in FIGS. 3, 4 and 5. Slidably restrained within housing 15 is half cylinder member 18, which is integrally formed to include a half cylinder 19 attached to a substantially planar base member 20. A spiral or helical ridge 21 extends along substantially the entire longitudinal length of the surface of semi-cylinder 19, with ends 22 and 23 (FIG. 5) terminating at the surface of planar base member 20. Also formed within planar base member 20 is gear recess 24 which includes step-wise indentations 25, 26, 27 and 28 which are formed so as to cooperatively matingly receive gear teeth 29, 30, 31 and 32 of an external gear hub 33. The gear and gear recess cooperatively form a pawl and ratchet configuration for converting rotational operator movement of an operator handle into longitudinal drive motion for driver base member 20, as is described in more detail below. It should be noted, however, that the operation of the latch assembly of this invention is not to be construed as limited to requiring a "rotational" operator input. Longitudinal movement of the driver base member 20 could equally well be effected for example by linear or arcuate operator movement of an operator handle, in which case the pawl and ratchet assembly of the gear recess 24 and gear hub 33 would be replaced by operational force translating means appropriate to the type of operator input stimulus being received.

Latch member 14 is formed so as to have a vertical lock bolt member 34 supported by horizontal members 35 and 36. Horizontal members 35 and 36 are affixed or integrally formed with a cylinder sector 37, which in a preferred embodiment encompasses between 20° and 60° of arc. Formed within cylinder sector 37 is a spiral groove 38 which is compatibly formed so as to cooperatively receive spiral ridge 21 of half cylinder member 19. In operation, spiral groove 38 rides continuously along spiral ridge 21 and cylinder sector 37 cooperatively engages and rides along the outer surface of half cylinder member 19. Planar base member 20 si slidably restrained for longitudinal movement by housing 15 within recess 39 of the housing.

As shown in FIG. 2, an operator handle 40 is attached in the preferred embodiment, to the shaft 41 (FIG. 5) such that rotation of handle 40 causes gear hub 33 to rotate within recess 24. Rotation of handle 40 causes planar drive member 20 to translate in a longitudinal (vertical) direction as gears 29–32 engage steps 25–28 within recess 24. As seen in FIG. 2, rotation of handle 40 in the direction shown by arrow 42 will cause planar drive member 20 to translate vertically in the direction shown by arrow 43. In response to such movement, ridge 21 riding within groove 38 causes cylinder sector 37 to move along the surface of half cylinder 19, thereby causing latch member 14 to rotate in the direction shown by arrows 16. Conversely, rotational movement of the handle 40 in a direction opposite to that shown by arrow 42 will cause planar drive member 20 to longitudinally move downwardly in the direction shown by arrow 44, thereby causing latch member 14 to rotate in a direction opposite to that shown by arrows 16.

The particular advantages of this unique structure may best be realized by reference to FIGS. 3, 4 and 5. In FIG. 3, latch member 14 is shown in an "open" position corresponding to its position as illustrated in FIG. 2. The vertical lock bolt member 34 can be seen to have a principle beveled surface 45 which terminates in a pair of oppositely disposed flat side surfaces 46 and 47. Surface 47 of member 34 lies substantially orthogonal to surface 46. In a typical installation of sliding window members, when the latching assembly is "open" so as to allow window panels 2 and 3 to move relative to one another, that outer surface 11*a* of sash 11 which addresses sash 17 is separated from the opposing surface 17*a* of sash 17 by a certain dimension 50*a*. Although the exact dimension is unimportant, the dimension 50*a* will typically be between 1/32 inch and ½ inch to enable the window panels 2 and 3 to longitudinally move relative to one another without rubbing against each other or their associated weather stripping. When the latching assembly is disposed in such "open" position (FIG. 3) the latch member 14 is rotated sufficiently back toward the general plane of the surface 17*a* of the window sash 17 such that the lock bolt surface 47 generally lies coplanar with the plane of surface 17*a* so that it will not touch the window panel 2 when the panels 2 and 3 are moved relative to one another.

When it is desired to secure or latch the window panels 2 and 3 within the frame 5, the window panels 2 and 3 are longitudinally moved to a generally closed position within the frame 5 such that the protrusion 12 of the keeper 6 is cooperatively aligned opposite the latch member 14, as illustrated in FIG. 3. To "engage" or close the latching assembly, the operator handle 40 is rotated approximately 90°, moving the drive member 20 and causing half cylinder member 18 to translate, thereby rotating member 34 through an arc of approximately 70°. As member 34 travels along path 51, (FIG. 4) the edge 52 of keeper member 12 engages surface 45 of member 34. Due to the inclination of surface 45, edge 52 slides in camming motion along surface 45, thereby urging edge 52 in the direction shown by arrow 53. This action pushes the ends 48 and 49 of window panels 2 and 3 respectively longitudinally away from one another, tightening the window panels against the opposing end jambs of the frame 5. This action also begins to draw the window sash panels 2 and 3 laterally toward one another as illustrated in FIG. 4. As the sash panels are drawn toward one another, the end 48 of sash 11 will be separated by a dimension 55*b* (FIG. 4) from the end 49 of sash 17 by a separation spacing which is less than dimension 55*a* (FIG. 3) which represents the original separation between sash ends 48 and 49. As member 34 continues to rotate, surface 46 pulls protrusion 12 and keeper 6 toward sash 17 along the direction represented by arrow 56, thereby causing narrowing dimension 50*b* such that it is less than the original dimension 50*a* as shown in FIG. 3. As member 34 continues to rotate to its final closure position as shown in FIG. 5, the edges of surfaces 47 and 46 continuously apply closure pressure in two orthogonal directions to the inner walls 13*a* and 12*a* of keeper member 12 to operatively maintain the window sash panels 11 and 17 in the closed/locked position. When in such closed or secured position, the window panels are longitudinally pushed outwardly to snugly engage the outer window frame 5 and are simultaneously laterally pulled toward each other to compress any weather stripping (not shown) disposed between the panels and between the panels and frame, to provide a weathertight seal across the frame opening. The eccentric nature of the rotational latching members in cooperation with the unique camming configuration tends to maintain the latched window panels in such "closed" position until the latching assembly is positively released by operator activation of the handle 40.

It will be understood by those skilled in the art that member 34 and its particular beveled arrangement could be altered depending on the configuration of keeper member 12, as long as a snug arrangement is provided between the two members, such that keeper member 12 is urged toward frame 17 along two substantially orthogonal horizontal directions.

In the preferred embodiment of the invention, the lock bolt member is constructed of a sturdy metal material such as steel or stainless steel and the keeper, housing and driver members are constructed of plastic materials such as acetal or reinforced nylon. It will be understood, however, that other suitable materials could equally well be used.

Although the invention has been described in its preferred form with a certain degree of particularity, it will be understood that the present disclosure of the preferred form has been made only by way of example, and that numerous changes in the details of construction and the combination and arrangement of parts and the like may be resorted to without departing from the spirit and scope of the invention as hereinafter claimed. It is intended that the patent shall cover, by suitable expression in the appended claims, whatever features of patentable novelty exist in the invention disclosed.

I claim:

1. A latching mechanism, comprising:

(a) a base member;

(b) at least a portion of cylinder, the cylinder being affixed to the base member;

(c) a track, the track being formed along a surface of the cylinder portion, the track being formed as a spiral ridge, the spiral ridge passing through approximately 180° of arc;

(d) a discrete cylinder sector surface, the cylinder sector surface being slidably engaged with the surface of the cylinder portion;

(e) a mating track segment, the mating track segment being formed within a portion of the cylinder sector surface, the mating track portion engaging the track formed on the cylinder portion;

(f) a latch, the latch being affixed to the cylinder sector surface such that translational movement of the base member causes the latch to rotate about an axis parallel to the direction of translational movement; and (g) a housing, the housing being configured so as to restrain translational movement of the base member to a single axis, the housing confining the cylinder sector surface to rotation about the axis of the base member translational movement.

2. The latch assembly of claim 1, wherein the mating track on the cylinder sector portion is formed as a spiral groove.

3. The latch assembly of claim 2, wherein the latch is formed having a top member, a bottom member, and a side member, the side member being supported between the top and bottom member, the top and bottom members each being affixed to the cylinder sector.

4. The latch assembly of claim 3, wherein the side member is substantially parallel to the axis of translational movement of the base member.

5. The latch assembly of claim 4, wherein the side member is formed so as to have at least one beveled surface, the beveled surface being configured so as to facilitate movement along a keeper member during the process of engaging the latch with the keeper.

6. The latch assembly of claim 5, wherein the latch side member further comprises at least a first and second surface, the first surface being adjacent to the beveled surface, the second surface being adjacent to another portion of the beveled surface, wherein the first and second surface are adapted to mate with disparate surfaces of a keeper member.

7. The latch assembly of claim 6, wherein the latch side member first and second surfaces are oriented in a substantially orthogonal relationship.

8. The latch assembly of claim 7, wherein the base member further comprises a cavity, the cavity being adapted to receive a rotating member, the rotating member engaging a portion of a surface of the cavity such that rotation of the rotating member causes translation of the base member along an axis.

9. A sliding closure securing assembly, comprising:

(a) a keeper member, the keeper member being rigidly affixed to a first closure panel;

(b) a swinging latch, the swinging latch being mounted to a second closure panel, wherein rotational movement of the swinging latch causes engagement of the latch with the keeper member such that the keeper member is urged to translate along two mutually orthogonal axes; and (c) a cylinder sector surface member, the latch being rigidly affixed to the cylindered sector surface member, the cylinder sector surface member being confined to rotate about an axis which is mutually orthogonal to the other two axes.

10. The closure assembly of claim 9, further comprising a translating base member, the cylinder sector surface member slidably engaging the base member, the base member being confined to linear movement along the axis of cylinder sector surface member rotation.

11. The closure assembly of claim 9, wherein the base member comprises a semi-cylindrical member, the semi-cylindrical member being configured to cooperatively engage the cylinder sector surface member.

12. The closure assembly of claim 10, wherein the semi-cylindrical member further comprises a spiral ridge, the spiral ridge extending through 180° of arc and along substantially the entire length of the semi-cylindrical member.

13. The closure assembly of claim 11, wherein the cylindrical sector surface member further comprises a spiral groove, the spiral groove being compatibly shaped so as to engage the spiral ridge of the semi-cylindrical member.

14. The closure assembly of claim 12, further comprising a housing, the housing being compatibly shaped so as to confine the cylinder sector surface member to rotational movement about the semi-cylindrical member.

15. A method of securing cooperatively sliding closure panels, the sliding closure panels sliding along a first axis and residing in first and second parallel planes, comprising:

(a) mounting a keeper member on a first sliding closure panel;

(b) mounting a swinging latch on a second sliding closure panel in cooperative alignment with said keeper member, said swinging latch being rotatable through an arc of approximately 70° about a second axis, the second axis being substantially orthogonal to the first axis traveled by the sliding closure panels;

(c) rotating an operator handle through a first arc, the first arc residing in a second plane, the second plane being parallel to the first and second planes defined by the sliding closure panels; and (d) mechanically interconnecting the operator handle to the swinging latch such that rotating the operator handle causes rotation of said swinging latch so as to engage said keeper member therewith; wherein rotation of said latch simultaneously imparts translation forces to said keeper member along two mutually orthogonal axes.

* * * * *